United States Patent [19]

Rohringer et al.

[11] Patent Number: 4,923,318

[45] Date of Patent: May 8, 1990

[54] INK FEED FOR A FOUNTAIN PEN

[75] Inventors: Thomas Rohringer; Horst Schrage, both of Hamburg, Fed. Rep. of Germany

[73] Assignee: Montblanc-Simplo GmbH, Hamburg, Fed. Rep. of Germany

[21] Appl. No.: 257,102

[22] Filed: Oct. 13, 1988

[30] Foreign Application Priority Data

Oct. 31, 1987 [DE] Fed. Rep. of Germany ..... 3736954

[51] Int. Cl.[5] ..... B43K 5/18

[52] U.S. Cl. ..... 401/225; 401/229

[58] Field of Search ..... 401/221, 222, 225–229, 401/230–231, 238, 241, 256, 232, 240, 248, 258, 239, 242, 223

[56] References Cited

U.S. PATENT DOCUMENTS

| | | | |
|---|---|---|---|
| 1,107,641 | 8/1914 | Badini | 401/240 |
| 1,498,558 | 6/1924 | Liddell | 401/228 |
| 1,574,930 | 3/1926 | Pollock | 401/227 |
| 1,908,123 | 5/1933 | Cuthbert | 401/240 X |
| 2,337,343 | 12/1943 | Para | 401/227 X |
| 3,182,636 | 5/1965 | Perry | 401/227 X |

FOREIGN PATENT DOCUMENTS

| | | | |
|---|---|---|---|
| 860294 | 2/1961 | United Kingdom | 401/227 |

*Primary Examiner*—Richard J. Apley
*Assistant Examiner*—D. F. Crosby
*Attorney, Agent, or Firm*—Nixon & Vanderhye

[57] ABSTRACT

An ink feed for a fountain pen has a main body provided with radial ink holding chambers, the rear end of which can be connected with the ink reservoir of a fountain pen, and which has on the nib support side an axially running groove to receive an inset, between which inset and the base of the groove, an air channel and at least one capillary ink feed channel are formed. The front end of the ink feed channel opens into an ink reserve space constructed between the main body and the inset, which space is connected via a capillary ink exit slit between the front end region of the inset and the main body, with the nib support surface. The ink exit slit extends from the middle of the groove to its two sides and at least with partial sections to the rear.

20 Claims, 9 Drawing Sheets

INK FEED FOR A FOUNTAIN PEN

BACKGROUND AND SUMMARY OF THE INVENTION

The invention relates to an ink feed component for a fountain pen. There are known in the art ink feed components which include a main body provided with radial ink-holding chambers, located intermediate forward and rearward ends thereof. The forward end is provided with a nib supporting surface, while the rearward end is adapted for connection to the ink reservoir of the fountain pen. On the nib support side of the ink feed, an axially extending groove is provided for receiving an inset, such that between the inset and the base of the groove, an air channel and at least one capillary ink feed channel are formed.

In a known ink feed of this type (DE-AS 1 034 066) two capillary ink feed channels extend in the base of a groove forming an air channel in the main body, and connect the rear end of the main body with the nib support surface. These two ink feed channels deviate in the region of the front end of the main body from their otherwise straight course, by curving towards the nib support surface, so that they emerge on the nib support surface, and so that direct wetting of the under side of the nib takes place with ink from the ink feed channels.

In practice, it has been discovered that in many cases the continuity of the ink film breaks between the nib and the exit openings of the ink-feed channels when the nib spreads slightly (due to increased writing pressure) and is lifted from the nib support surface of the ink feed. It is also possible, particularly with nibs used for wider lines, and when there is a greatly fluctuating writing pressure, that the ink feed channels are not capable of automatically supplying the larger quantity of ink required under such circumstances.

The object of this invention is to provide an ink feed in which the ink film between the ink feed and the nib does not break, even under increased writing pressure.

To achieve this object, an ink feed of the type specified in the introduction is improved in accordance with this invention, such that the front end of the ink feed channel opens into an ink reserve chamber formed between the main body and the inset, and such that the ink reserve chamber is connected to the nib support surface via a capillary ink exit slit located between the front end area of the inset and the main body. This ink exit slit extends from the longitudinal axis of the ink feed, (which extends through the center of the groove), out to its two sides, with at least partial side sections extending to the rear.

In the ink feed according to the invention, the supply of ink to the nib does not therefore take place directly from the capillary ink feed channel or channels, but from an ink reserve space charged by one or more of the channels, so that even when there is greater ink consumption, sufficient ink can be drawn from the ink reserve space, which forms a type of buffer. Due to this arrangement, there is surprisingly an almost complete suppression of the pressure fluctuations, caused by other pressure fluctuations in the ink reservoir due to consumption of ink and entry of air, which otherwise occur in the region of transfer to the nib and accompanying retraction of the ink meniscus.

As indicated above, the supply of ink from the ink reserve space to the nib takes place via a capillary ink exit slit, the front area of which lies directly below the nib groove. The slit also extends both to the side and to the rear, so that when not in use or when there is low writing pressure, wetting of the nib takes place through the entire ink exit slit including the region immediately below the nib groove even when the nib is not positioned in the exact center. When there is increased writing pressure, resulting in the spreading of the nib, the ink film between the region of the ink exit slit lying directly below the nib groove and the nib may be broken; however, an ink film is reliably maintained between the remaining region of the ink exit slit and the nib on both sides of the nib groove.

In a related aspect of the invention, a high degree of ink evaporation from the ink reserve space is prevented by the ink exit slit. When the ink does evaporate, ink is additionally drawn again from the ink feed channel into the ink reserve space, thereby supplying ink to the ink exit slit. This produces very good start of writing performance.

The ink exit slit can, for example, be U-shaped, wherein the arms of the U extend directly to the rear but can, if desired, diverge outwardly to the rear. Additionally, the passage from the base of the U to its arms can take place via a rounded region or an angled region.

It is also possible to form the ink exit slit in the shape of a V or to form it in a curve such that the ends of the curve lie further to the rear than its central curved region.

In order to ensure that ink is fed to the writing nib when using nibs for wider lines, the distance between the neighboring sides of the main body and the inset which border on the ink reserve space can gradually decrease from the outlet region of the ink feed channel to the ink exit slit. In this way, a relatively large volume of ink is collected in the ink reserve space, and because the capillary forces act more strongly there due to the narrowing of the ink reserve space towards the ink exit slit, the ink is carried reliably to the ink exit slit and therefore to the writing nib.

As described, the ink reserve space can also taper to the front in a wedge-shape along the longitudinal axis of the ink feed which extends through the center of the groove.

As already mentioned above, by providing the ink reserve space and the ink exit slit according to the invention, a reliable supply of ink to the writing nib is ensured even under difficult writing conditions. The ink feed according to the invention is therefore suitable both for narrow-line nibs and for wider-line nibs.

In a preferred embodiment of the invention, the ink feed channel (channels) is (are), formed on the under side of the inset.

In this way, it is necessary to provide only one form of a main body for the ink feed, and to adapt the insets for nibs of different line widths by using an appropriately formed inset, with the ink feed channel or channels so dimensioned that they transport the appropriate quantity of ink to the front end of the ink feed, the inset being so formed that together with the main body it forms an ink reserve space and an ink exit slit with dimensions suitable for the current application.

When an inset of this type is used, transverse channels can be provided on the under side of the inset to connect with the radial ink holding chambers.

In order to be able to position the inset precisely in the main body so that an ink exit slit of the desired size can be obtained within the most narrow specifications, positioning projections can be constructed in the front end region of the inset on its side walls.

It has also proved advantageous to form the radius of curvature of the outer surface of the inset in the region of the nib support surface such that it is larger than the radius of curvature of the outer surface of the main body which joins in the circumferential direction, so that the radius of curvature of the outer surface of the inset exactly matches the radius of curvature of the nib. This results in a further improvement of the ink feed.

Further objects and advantages will become apparent from the detailed description which follows.

DETAILED DESCRIPTION OF THE DRAWINGS

Figure 1:
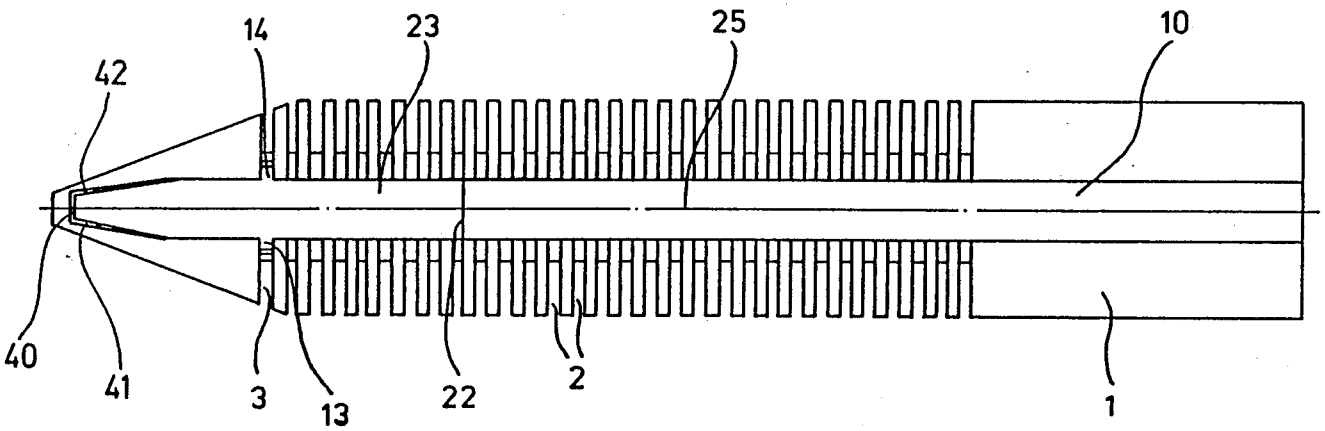
FIG. 1 is a top plan view of an ink feed component for a fountain pen in accordance with the present invention.
Figure 3:
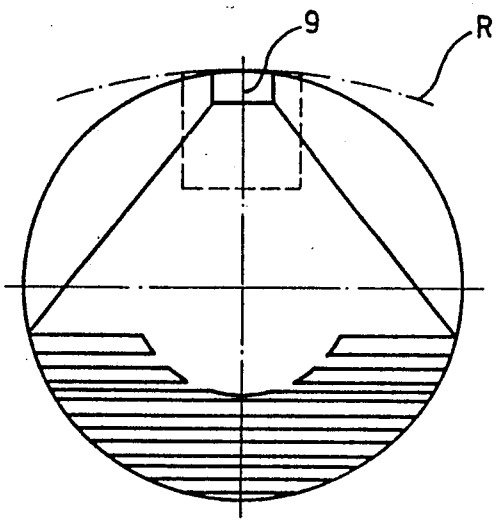
FIG. 3 is a front view (from the left) of the ink feed shown in FIG. 1.
Figure 2:
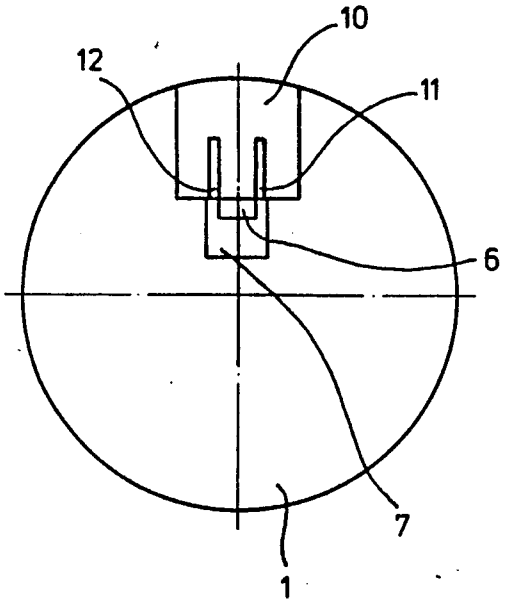
FIG. 2 is a rear view (from the right) of the ink feed shown in FIG. 1.

The ink feed component illustrated in FIGS. 1 to 13 comprises a main body 1 and an inset 10. Both the main body and the inset are usually made from plastic and can be manufactured in an injection moulding process.

It will be understood that the main body may be connected firmly at its rearward end (right end in FIGS. 4 and 5) to a fountain pen. In a central region, the main body 1, has ink holding chambers 2 arranged radially in a conventional manner. An axial groove 4, having a substantially rectangular cross-sectional shape, extends from the rear end of the main body and terminates at the front of the main body in a surface 33. At the rear of the main body, in the base of the groove 4, there is an air channel 7 (FIG. 8) which, when the pen is assembled, is connected to the ink reservoir. At the forward end of channel 7, there is a conventional pressure regulating region 6, which connects with an air channel 5 extending axially to the front of the main body, and is there connected via a transverse groove with the foremost air-entry channels 3.

Figure 4:
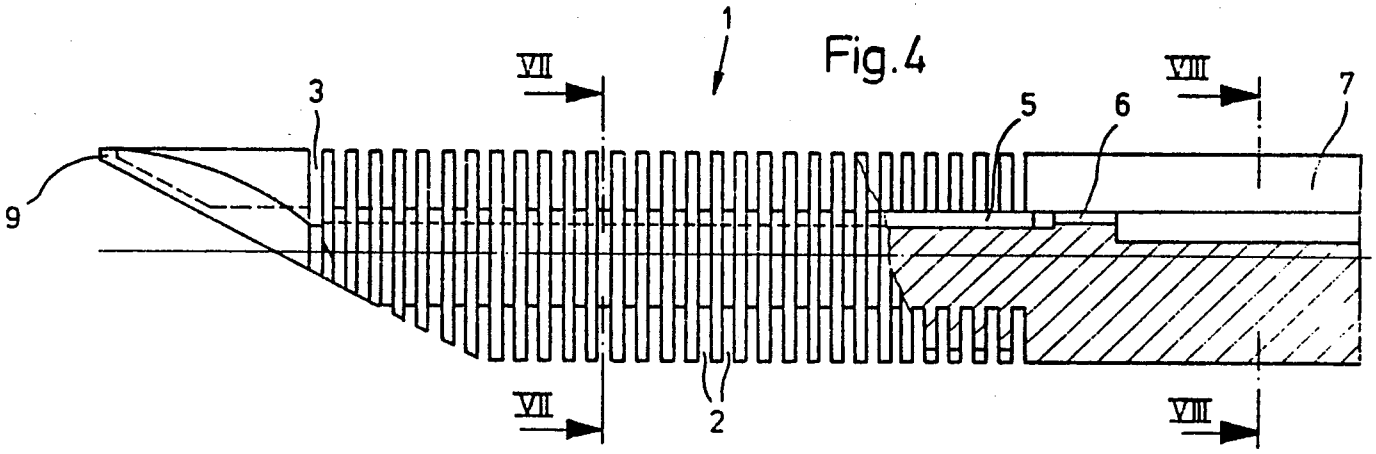
FIG. 4 is a side view, partly in section, of the main body portion of the ink feed shown in FIGS. 1 to 3, with an inset element removed therefrom.
Figure 5:
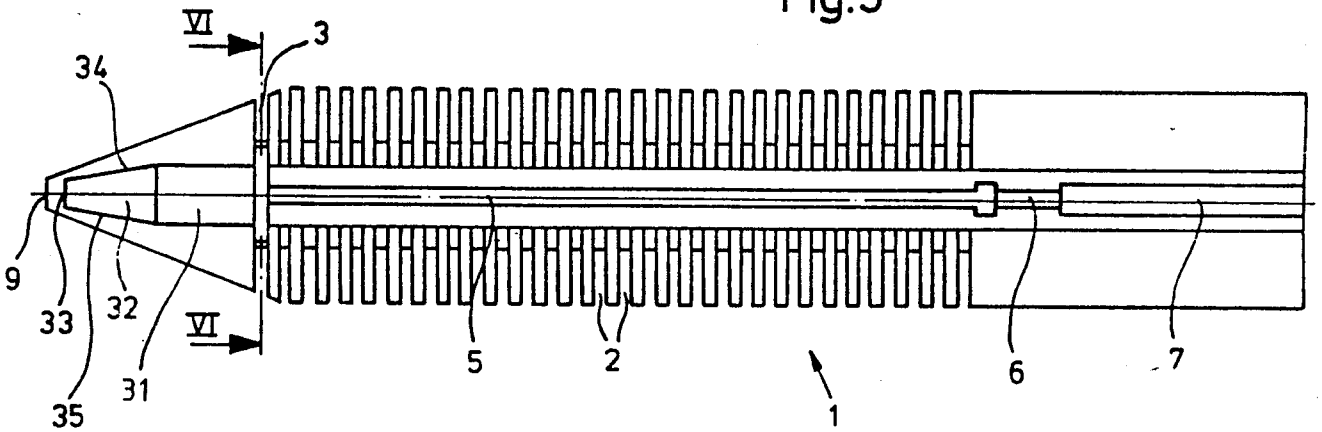
FIG. 5 is a plan view of the main body portion shown in FIG. 4.
Figure 8:
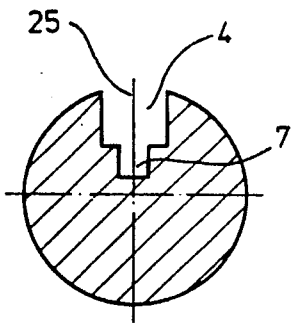
FIG. 8 is a section taken along the line VIII—VIII in FIG. 4.
Figure 7:
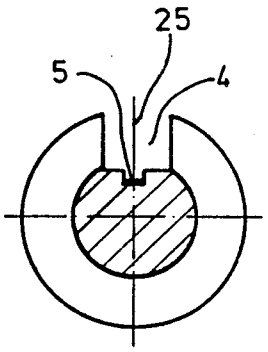
FIG. 7 is a section taken along the line VII—VII in FIG. 4.
Figure 6:
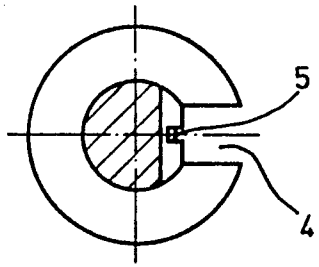
FIG. 6 is a section taken along the line VI—VI in FIG. 5.
Figure 12:
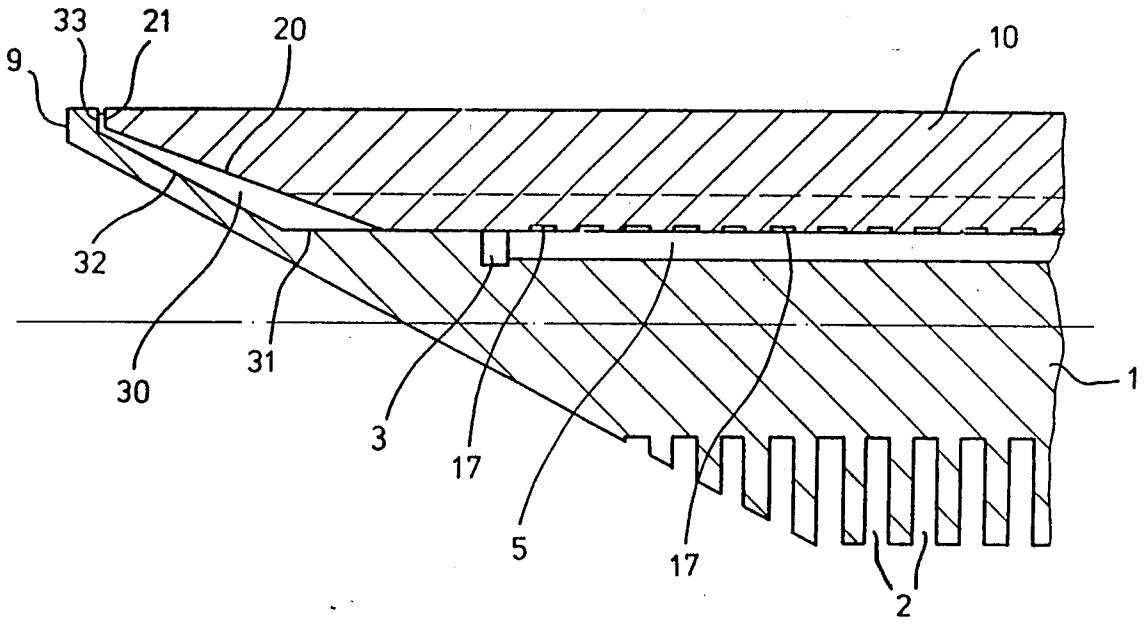
FIG. 12 shows in an enlarged partial section the front end region of the ink feed component shown in FIGS. 1 to 3.

As best seen in FIGS. 4, 5 and 12, the base surface of a groove 31 which lies in front of the air entry channel 3, and no longer has the air channel running through it, merges into an upward slanting surface 32, which terminates at the surface 33, while the side walls of the groove 4 form wall sections 34 an 35 (FIG. 5) which converge from the transition point between surfaces 31 and 32 towards the front. The terminating surface 33 of the groove 31 lies a relatively small distance behind the front surface 9 of the main body 1.

Figure 9:
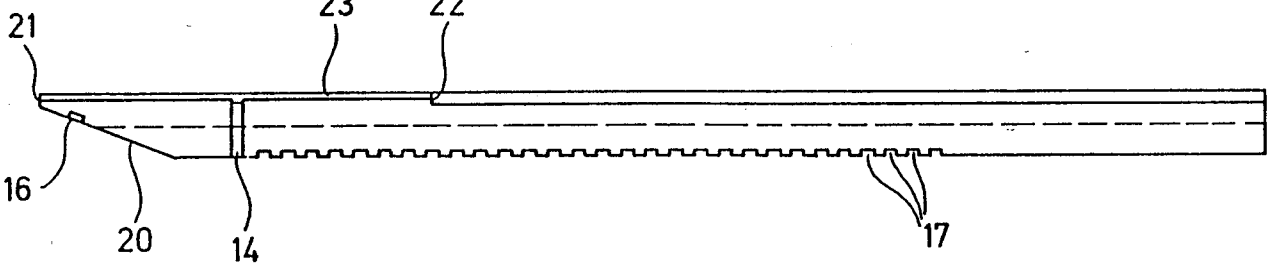
FIG. 9 is a side view of an inset removed from the ink feed component shown in FIGS. 1 to 3.
Figure 10:
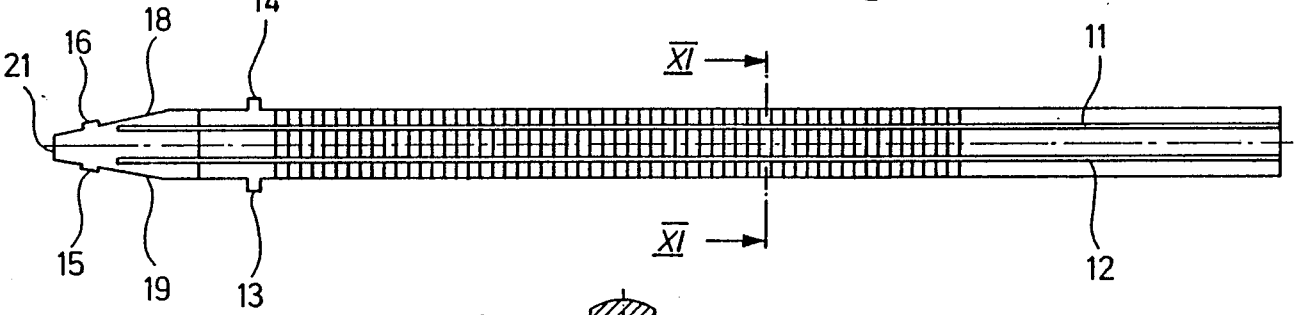
FIG. 10 is a bottom plan view of the inset shown in FIG. 9.

With reference to FIGS. 9 and 10, it may be seen that inset 10 is shaped such that it fits into the groove 4 of the main body 1, and extends from the rear end of the main body to just short of the wall or surface 33.

Figure 11:
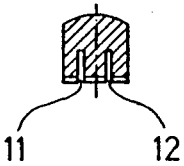
FIG. 11 is a section taken along the line XI—XI in FIG. 10.

The inset 10 has on its under side two capillary-shaped ink feed channels 11, 12, which extend from the rear end of the inset 10 (on the right as viewed in FIGS. 9 and 10) to just short of its front end as best seen in FIG. 11. On the under side of the inset 10, transverse channels 17 are also provided (FIGS. 9, 10 and 12) which, when the pen is assembled, connect the air channel 5 formed in the main body 1 with the radial ink holding chambers 2.

The top side of the inset 10 is curved in the circumferential direction in the region behind a step 22 formed in the inset (FIGS. 1 and 9) corresponding to the main body 1 that accommodates the inset 10, while the region 23 which forms the nib support surface, and which lies in front of the step 22 (FIGS. 1 and 9), has a greater radius of curvature corresponding to the inner radius R (FIG. 3) of the nib to be attached, while the surfaces of the main body joining the circumferential direction have a smaller radius of curvature.

As can be seen from the FIGS. 9 and 10, a lower surface section 20 of the inset 10 slopes upwardly in the forward region of the inset until it reaches a forward terminating surface 21. In addition, the side wall sections 18 and 19 in the front end region converge until they intersect the forward surface 21. To the rear of the transition to side wall sections 18 and 19, there are formed positioning projections 13 and 14 which engage with the air entry channel 3 when the inset 10 is inserted into the groove 4 of the main body 1. Further positioning inside the groove 4 is carried out by means of the projections 15 and 16 provided on the side wall sections 18 and 19. These projections engage side wall sections 34 and 35 of the groove 4 in the main body 1 (FIG. 13).

When the inset 10 is inserted in the main body 1, the air channel 5 extends between these two components and is connected via transverse grooves 17 with the radial ink holding chambers 2. At the same time, the capillary ink feed channels 11, 12 ensure the supply of ink from the ink reservoir of the fountain pen to the front end of the ink feed. In the present invention, and in a departure from known arrangements, the capillary ink feed channels 11 and 12 are formed in the inset 10.

The capillary ink feed channels 11 and 12 extend in a straight line for their entire length and open, as illustrated best in FIG. 12, at their front end into an ink reserve space 30. This ink reserve space is bounded on its under side by the wall section 31 of the groove 4 and the inclined wall section 32 in the main body 1, and on its upper side by the inclined wall section 20 of the under side of the inset 10. Laterally, the boundary at the front is defined by the wall 33 and on the sides by the wall sections 34 and 35 of the main body 1. Due to the different slopes of the wall section 32 of the main body 1 and the wall section 20 of the inset 10, the ink reserve space tapers inwardly from the opening region of the ink feed channels 11 and 12 in a wedge shape towards the front of the ink feed.

Figure 13:
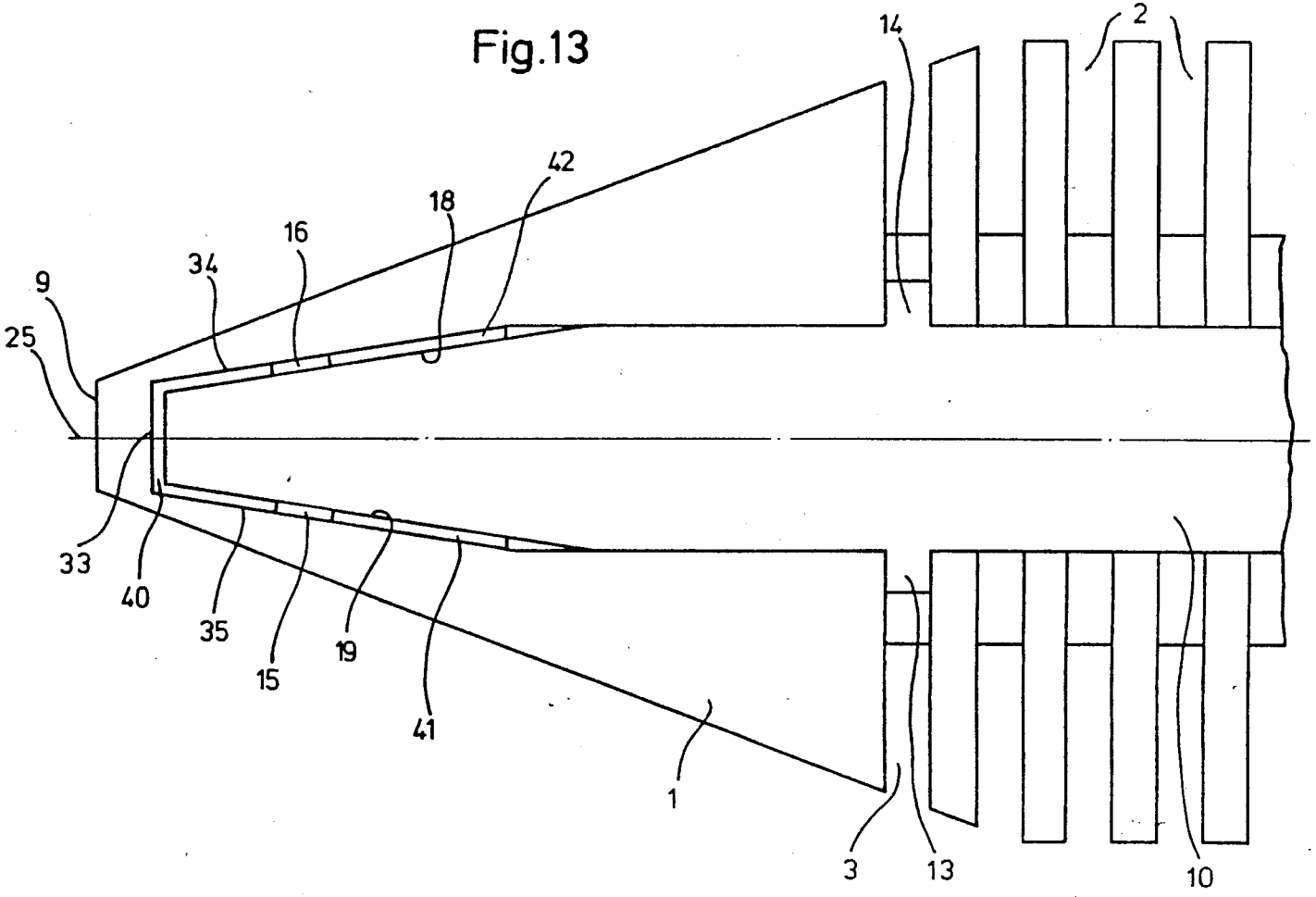
FIG. 13 is an enlarged partial top plan view of the front end region of the ink feed shown in FIGS. 1–3.

As is also shown in FIGS. 12 and 13, the front surface 21 of the inset 10 is spaced a small distance behind the wall 33 of the main body 1 and the side wall sections 18 and 19 of the inset 10 run at a corresponding distance from the side wall sections 34 and 35 of the main body 1, so that between these walls a capillary ink exit slit is formed which is open to the nib support surface, symmetrical about a longitudinal axis 25 of the ink feed and essentially U-shaped (FIG. 13), whereby the base 40 of the U lies transverse to the axis 25 and the arms 41, 42 of the U diverge from the base 40 outwardly toward the rear of the ink feed.

Thus, when a nib is attached, a very large region of contact results between the ink exit slit 40, 41, 42 and the nib, wherein the nib groove extends across the base 40. In this way, even when the nib is splayed out to a relatively great degree and partially lifted from the nib support surface, a good contact with regions of the ink exit slit 40, 41, 42 is always maintained, and the existence of an ink film between this and the nib is ensured. This is because sufficient ink can always be suppled from the ink reserve space 30 which tapers in the direction of the ink exit slit 40, 41, 42.

Figure 14:
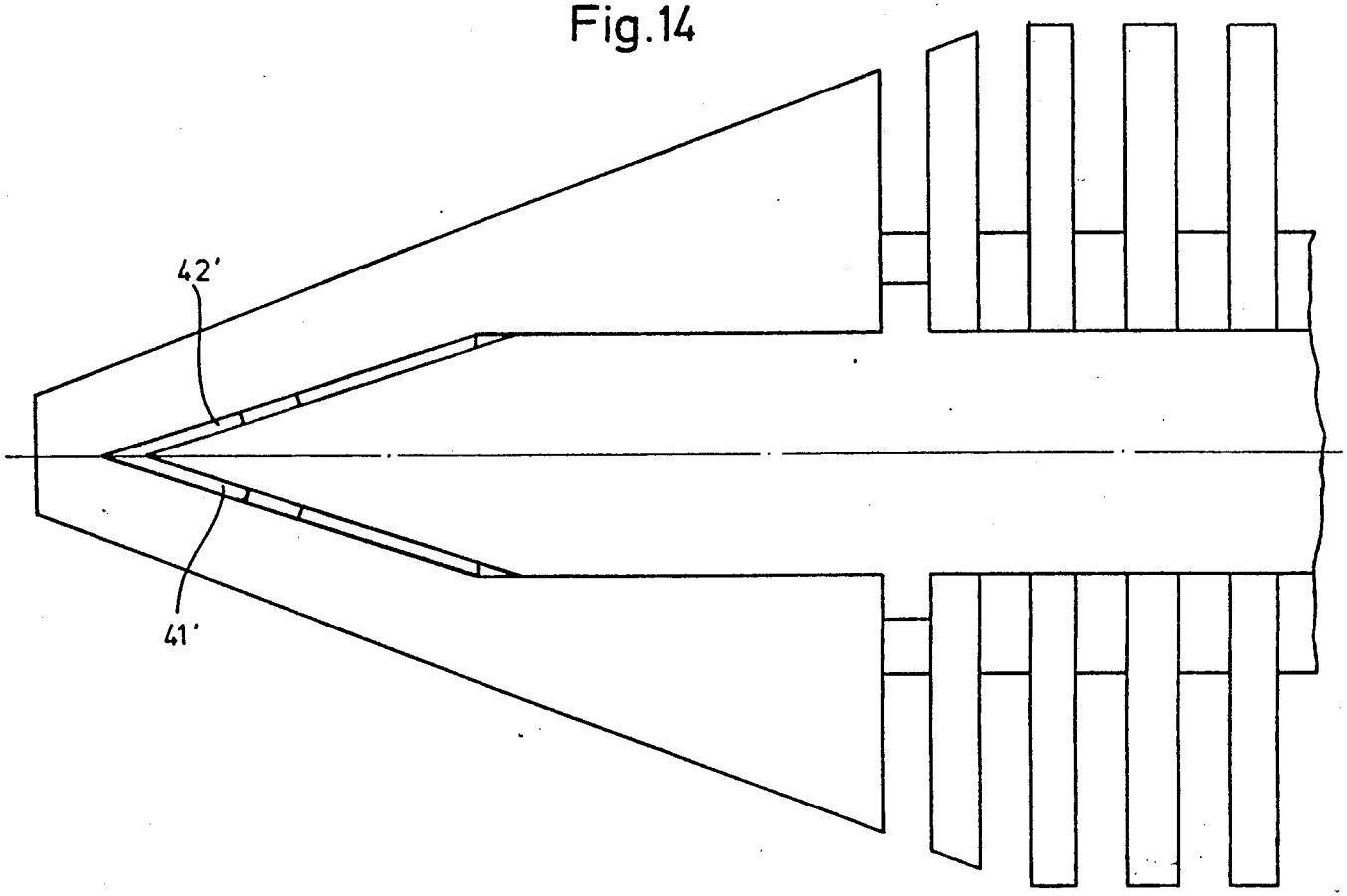
FIG. 14 is an enlarged partial top view of the front end region of an alternative ink feed in accordance with the invention.

While in FIG. 13 an essentially U-shaped ink exit slit is shown, the ink feed in FIG. 14 (otherwise constructed in the same manner as the ink feed in FIGS. 1 to 13) has a V-shaped ink exit slit with two arms 41' and 42' which lie symmetrically on each side of the longitudinal axis 25.

Figure 15:
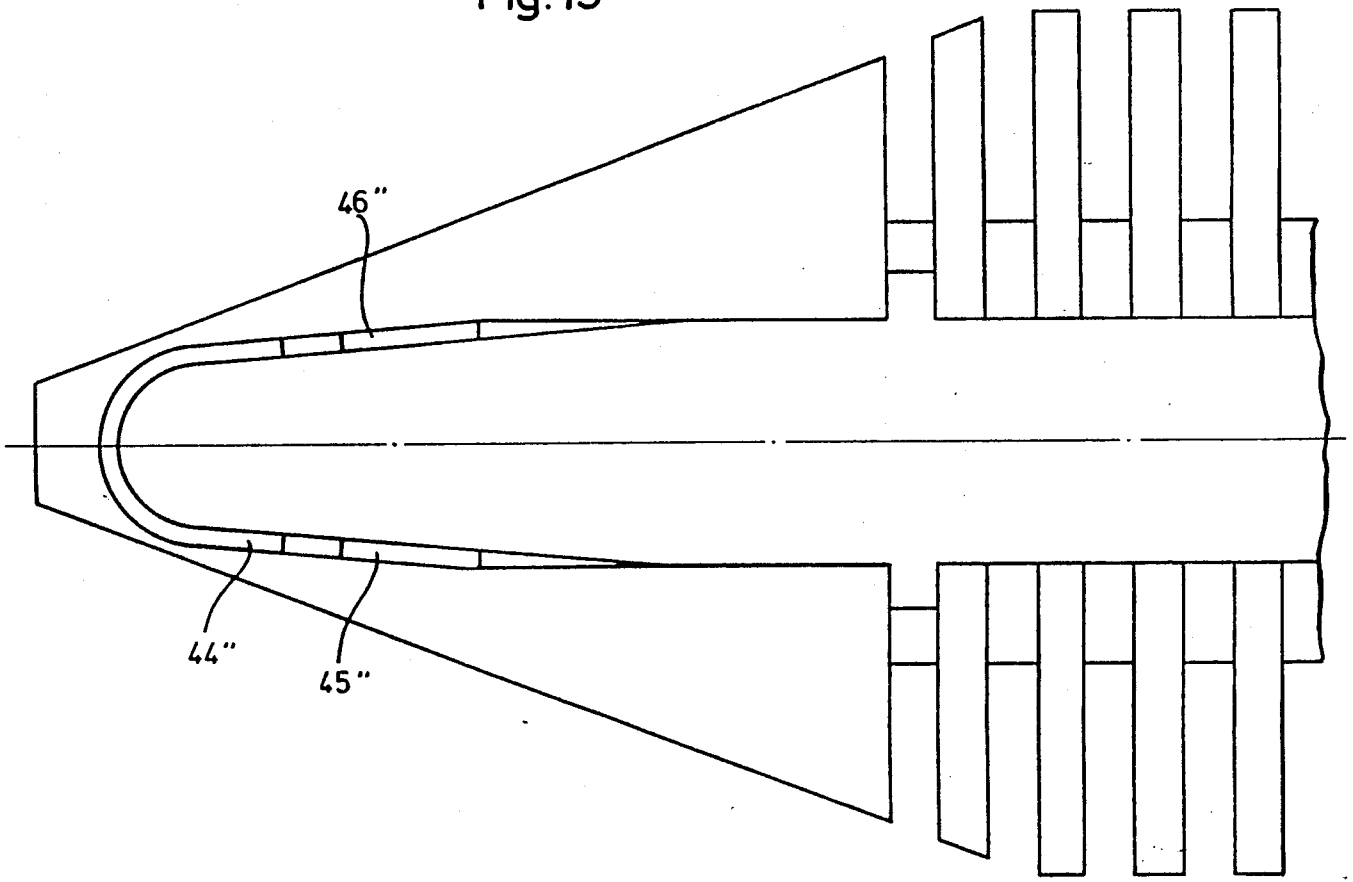
FIG. 15 is an enlarged partial top view of the front end region of another alternative ink feed in accordance with the invention.

An additional suitable shape for an ink exit slit is shown in FIG. 15. This ink exit slit 44" is curved, and in fact, substantially arc-shaped, and ends at the rear at points 45" and 46" which are clearly located further out and behind its foremost central region.

Since the ink feeds in FIGS. 14 and 15 are formed in the same way as the ink feed in FIGS. 1 to 13, no additional reference numerals are given in the FIGS. 14 and 15 and no additional explanations are necessary.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An ink feed for a fountain pen comprising:

a main body having a forward end and a rearward end, the forward end having a nib support surface, and the rearward end adapted for connection to an ink reservoir of the fountain pen, the main body portion further provided with a plurality of ink holding chambers located intermediate the forward and rearward ends, and an axially extending groove extending between the forward and rearward ends;

an inset receivable within said groove and configured such that an axially extending air channel and at least one axially extending capillary ink feed channel are formed between the insert and a base of the groove;

wherein the forward end of the main body and a forward end of the insert cooperate to form an ink reserve and an ink exit slit, said ink reserve being substantially covered by said inset and connected to the ink exit slit at a first end thereof, and to said at least one capillary ink feed channel at a second end thereof, such that said ink exit slit and said at least one capillary ink feed channel are connected only through said reserve, and wherein said axially extending air channel is spaced from said reserve.

2. An ink feed as defined in claim 1, and wherein said plurality of ink holding chambers are oriented radially relative to a longitudinal axis of the main body.

3. An ink feed as defined in claim 1, and wherein said ink exit slit extends laterally at least to either side of a longitudinal axis of the main body.

4. An ink feed as defined in claim 3, wherein said ink exit slit further extends toward the rearward end of said main body.

5. An ink feed as defined in claim 2, wherein said longitudinal axis extends along said axial groove.

6. An ink feed according to claim 5, wherein the ink exit slit is U-shaped.

7. An ink feed according to claim 5, wherein the ink exit slit is V-shaped.

8. An ink feed according to claim 5, wherein the ink exit slit is curved in a forward central region and wherein ends of the curve lie further back than said central region.

9. An ink feed according to claim 1, wherein wall portions of the main body and inset which form said ink reserve are separated by a distance which continually decreases from said ink feed channel to said ink exit slit.

10. An ink feed according to claim 1, wherein the ink reserve tapers forward in a wedge shape.

11. An ink feed according to claim 1, wherein said at least one capillary ink feed channel is formed on an under side of the inset.

12. An ink feed according to claim 1, wherein a plurality of cross-channels are provided on an under side of the inset.

13. An ink feed according to claim 11, wherein a plurality of cross-channels are provided on an under side of the inset.

14. An ink feed according to claims 1, wherein positioning projections are constructed on side walls of the inset.

15. An ink feed according to claims 1, wherein the radius of curvature of an outer surface of the inset proximate the nib support surface is greater than the radius of curvature of an outer surface of the main body which merges in the circumferential direction.

16. An ink feed for a fountain pen comprising:

a main body portion having a forward end and a rearward end, the forward end having a nib support surface, and the rearward end adapted for connection to an ink reservoir of a fountain pen;

an inset receivable within a groove formed in the main body; and ink feed means formed within the groove and an ink reserve formed between the main body and the inset, said ink reserve being tapered forwardly in a wedge shape, and wherein said inset extends over substantially the entire ink reserve said ink feed means feeding said ink reserve and said ink reserve feeding said nib support surface.

17. An ink feed as defined in claim 16 wherein said ink reserve feeds a substantially U-shaped exit slit in the nib support surface.

18. An ink feed as defined in claim 16 wherein said ink reserve feeds a substantially V-shaped exit slit in the nib support surface.

19. An ink feed in claim 16 wherein said ink feed means comprises a pair of capillary ink feed channels operatively connected to the ink reservoir.

20. An ink feed as defined in claim 19 wherein said pair of capillary ink feed channels are formed in said inset, and extend substantially parallel to each other.

* * * * *